US006972550B2

(12) United States Patent
Hong

(10) Patent No.: US 6,972,550 B2
(45) Date of Patent: Dec. 6, 2005

(54) BANDGAP REFERENCE VOLTAGE GENERATOR WITH A LOW-COST, LOW-POWER, FAST START-UP CIRCUIT

(75) Inventor: Hao-Chiao Hong, Hsinchu (TW)

(73) Assignee: Taiwan Semiconductor Manufacturing Co., Ltd., (TW)

( * ) Notice: Subject to any disclaimer, the term of this patent is extended or adjusted under 35 U.S.C. 154(b) by 0 days.

(21) Appl. No.: 09/974,084

(22) Filed: Oct. 10, 2001

(65) Prior Publication Data

US 2003/0067291 A1 Apr. 10, 2003

(51) Int. Cl.[7] ..... G05F 3/16
(52) U.S. Cl. ..... 323/315; 323/314
(58) Field of Search ..... 323/312, 315, 323/317, 314; 327/539

(56) References Cited

U.S. PATENT DOCUMENTS 4,371,843 A * 2/1983 Fang et al. ..... 330/253
6,016,050 A * 1/2000 Brokaw ..... 323/315
6,356,064 B1 * 3/2002 Tonda ..... 323/313

* cited by examiner

*Primary Examiner*—Gary L Laxton
(74) *Attorney, Agent, or Firm*—Butzel Long

(57) ABSTRACT

A bandgap voltage reference generator includes a bandgap voltage reference circuit and a fast startup circuit. The fast start-up circuit, which is cost-efficient and saves power consumption, can rapidly start up the bandgap reference voltage circuit coupled thereto. The fast start-up circuit comprises a P-channel MOSFET or an N-channel MOSFET. Upon the bandgap voltage reference generator being powered by an external DC voltage, the bandgap reference generator will possibly operate in the power-down operating state. At this time there exists a large voltage drop between the gate and the source of the P-channel MOSFET (or N-channel MOSFET), and thus a large current flows rapidly through the P-channel MOSFET (or N-channel MOSFET). Voltages of drains of two specific MOSFETs in the bandgap voltage reference circuit will thus be pulled to be substantially the same, and the bandgap voltage reference circuit is brought into a normal operating state. The output of the bandgap reference generator is then very close to the bandgap voltage of silicon.

19 Claims, 3 Drawing Sheets

BANDGAP REFERENCE VOLTAGE GENERATOR WITH A LOW-COST, LOW-POWER, FAST START-UP CIRCUIT

BACKGROUND OF THE INVENTION

1. Field of the Invention

The present invention relates to an electronic circuit, more particularly, to a bandgap reference voltage generator which includes a low-cost, low-power, fast startup circuit and a bandgap voltage reference circuit, wherein the startup circuit can rapidly start up the bandgap reference voltage circuit.

2. Description of the Prior Art

A robust reference voltage is a common demand of analog, memory, and power circuits. The robustness means that the reference voltage should be independent of applied power, temperature, and so on. The bandgap reference generator is widely used to generate such a robust reference voltage, having a zero temperature coefficient on a desired working temperature as well as a good power-noise rejection ratio.

Some technologies involved in the bandgap reference generator have been suggested. Among these, FIG. 1 illustrates one of the bandgap reference generators suggested in the prior art. The bandgap reference generator 10 in FIG. 1 includes 5 MOSFETs, MP1, MP2, MN1, MN2 and MP3, respectively; 3 diodes, D1, D2 and D3, respectively; and 2 resistors, R1 and RS, respectively. However, the circuit of the bandgap voltage reference generator 10 is a bistable circuit. Upon being powered by an external DC voltage, the bandgap reference generator possibly operate either in power-down operating state or normal operating state. The bistable circuit will remain in one operating state if no excitation is applied, and can change to the other operating state only when triggered by an external source.

Continuing to FIG. 1, in power-down operating state, no current flows through the transistors MP1, MP2, MN1 and MN2 in the circuit 10. At the time, the voltages of the node N3 and the node N2 differ from each other, and are very close to external DC voltage AVDD and AVSS respectively. At the time, the output voltage of the circuit of the bandgap reference generator is the cut-off voltage of the diode D3 which is around 0.4–0.5V. This output voltage is dependent on the temperature and is not robust enough for many applications.

In the normal operating state, the close loop formed by MP1, MP2, MN1, MN2, D1, D2, and R1 generates a reference current, which has a high power-rejection ratio and is proportional to absolute temperature. This current then mirrors to flow through MP3, RS and D3. By adjusting the resistance of RS, it is possible to obtain a zero temperature dependency output voltage on some desired temperature. The output follows the bandgap voltage of silicon, around 1.2V. The voltages of the node N2 and the node N3 can be adapted to be substantially the same by properly selecting the sizes of the transistor MP1, MP2, MN1 and MN2 to avoid an aging problem. Accordingly, the circuit 10 functions as an excellent provider for a steady voltage source.

In practical use, however, the circuit randomly operates in the normal operating state or power-down operating mode upon being powered by external DC voltage. It is desirable to have a trigger source provided for the circuit of the bandgap reference generator to force it into a normal operating state from the power-down operating state.

Some technologies have been proposed to address the undesirable off-state problem. Among them, the method of adding a start-up circuit to the circuit of the bandgap reference generator to force it into a normal operating state is most widely used.

FIG. 2 illustrates one of the proposed attempts at providing a start-up circuit for the bandgap reference voltage generator. The start-up circuit includes an operational amplifier 44 and an N-channel MOSFET MST 42. The start-up circuit is connected to the bandgap reference voltage circuit and is in charge of starting it up. The operational amplifier 44 is powered by an external DC voltage source AVDD, and an output voltage source AVDD' for the bandgap reference voltage circuit and the transistor MST 42. If the reference voltage circuit operates in power-down operating state, the voltages of the node N2 and the node N3 are very close to AVSS and AVDD respectively. At such time a large voltage difference will appear between the positive input and the negative input of the differential amplifier, and thus AVDD' will be driven to a voltage near AVDD. At such time the large gate-to-source voltage turns on the transistor MST 42. Then the current flowing through the transistor MST 42 pulls the voltage at node N3 to be lower, and the voltage at node N2 higher. The voltages at node N2 and node N3 will become constant until the two voltages are substantially the same. Then the correct bandgap voltage will be obtained at the output of the circuit 40.

In one aspect, the start-up circuit of the bandgap reference voltage generator mentioned above calls for an operational amplifier, thus increasing the hardware overhead. In another aspect, the offset voltage introduced by the operational amplifier conducts a current flowing through the transistor MST in a normal operating state, which will not only lead the MST operation into the triode region, but will cause the dependency curve of the output voltage of the bandgap reference voltage generator on the temperature to be shifted. The output voltage of the circuit no longer has a zero temperature coefficient on the working temperature. In another aspect, owing to the MST transistor operating in the triode region, any disturbance on AVDD' would cause variation of the output voltage of the bandgap reference voltage generator. In still another aspect, the bandgap voltage generator circuit is applied with a voltage AVDD' which is given from the output of the differential amplifier. Since AVDD' is always smaller than the external voltage source AVDD, the time taken to make the voltages on the node N2 and the node N3 to be substantially the same will be longer, which reduces the speed of starting up the bandgap reference voltage circuit.

Additionally, in U.S. Pat. No. 5,367,249 entitled "CIRCUIT INCLUDING BANDGAP REFERENCE," the start-up circuit calls for several transistors and resistors and thus increases the cost for the hardware.

SUMMARY

In response to the drawbacks of known technology mentioned above, the present invention discloses a bandgap reference voltage circuit with a low-cost, low-power consumption, and fast start-up circuit, which can rapidly start up the bandgap reference voltage circuit.

The bandgap reference voltage generator according to the present invention includes a bandgap reference circuit and a start-up circuit. The bandgap reference voltage circuit comprises 5 MOSFETs, 2 resistors and 3 diodes and the start-up circuit includes only a P-channel MOSFET or an N-channel MOSFET. The bandgap reference voltage generator will be forced into a normal operating state through adequate connection between the start-up circuit (e.g., the P-channel transistor or N-channel MOSFET) and the bandgap reference voltage circuit, and will provide a bandgap output voltage having a zero temperature dependency on some desired temperature.

Specifically, assuming the bandgap reference voltage is in the power-down operating state after being powered by an external DC voltage, the transistor of the start-up circuit will flow a current due to a large voltage drop between its gate and source (when the transistor is a P-channel MOSFET). The current will drive the source voltage down and then pull the gate voltage up. When the voltage difference between the gate and the source is smaller than the threshold voltage, the transistor goes off and the bandgap reference voltage generator leaves the power-down state.

When the bandgap reference voltage circuit is in its normal operating state, the transistor of the start-up circuit is off, which not only provides power savings but steady operating points immune to the variation of temperature. Additionally, the initial voltage drop between the gate and the source is larger than that in the prior art, and hence the current flowing through the transistor is larger, thus the time needed to drive the bandgap reference voltage generator out the power-down state is shorter. Additionally, the start-up circuit is relatively cost-efficient owing to the need for only one transistor for the start-up circuit.

BRIEF DESCRIPTION OF THE DRAWINGS

In order that the invention may be more clearly understood, it will now be disclosed in greater detail when taken in conjunction with the accompanying drawings, wherein.

DESCRIPTION OF THE PREFERRED EMBODIMENT

In one embodiment of the present invention, the bandgap reference voltage generator includes a start-up circuit and a bandgap reference voltage circuit. The start-up circuit includes a P-channel MOSFET connected to the bandgap reference voltage circuit, which is illustrated as FIG. 3. The source of the P-channel MOSFET MPS 52 is connected to the common gates of the transistor MP1 and MP2, the gate is connected to the drain of the transistor MP1, and the drain is connected to the lowest voltage AVSS in the bandgap reference voltage generator 50. If the generator is in power-down operating state after an external DC voltage is applied, the node N2 will have a voltage very close to AVSS, and the node N3 will have a voltage very close to the external DC voltage AVDD. Consequently, a large voltage drop will exist between the gate and the source of the transistor MPS 52, which is very close to AVDD−AVSS. Because the voltage AVDD−AVSS is apparently larger than the threshold voltage of the MPS 52, the transistor MPS 52 will turn on and conduct a current through MP2, and thus MP1 flows a current mirrored by the current flowing through the transistor MP2. The current flowing through MPS 52 will pull low the voltage at node N3 and pull high the voltage at node N2. Added with adjustment on the sizes of the transistor MP1, MP2, MN1 and MN2, the voltage difference between the voltages at the node N2 and the node N3 can be less than the threshold voltage of the transistor MPS 52, and then MPS 52 will be turned off. At such time the output voltage $V_{bngp}$ is well fixed at the correct bandgap voltage. It is noted that D1, which is at the path MN1 to AVSS, and R1 and D2, which is at the path MN1 to AVSS can be interchanged between their locations. With this interchange, the bandgap reference voltage generator can also achieve the original bandgap reference voltage output. But it is still noted that the cross sectional area of D2 must be larger than that of D1 to maintain the same voltage difference between the source of MN1 to AVSS and the source of MN2 to AVSS to retain a proper current mirror composed by MN1 and MN2.

Figure 1:
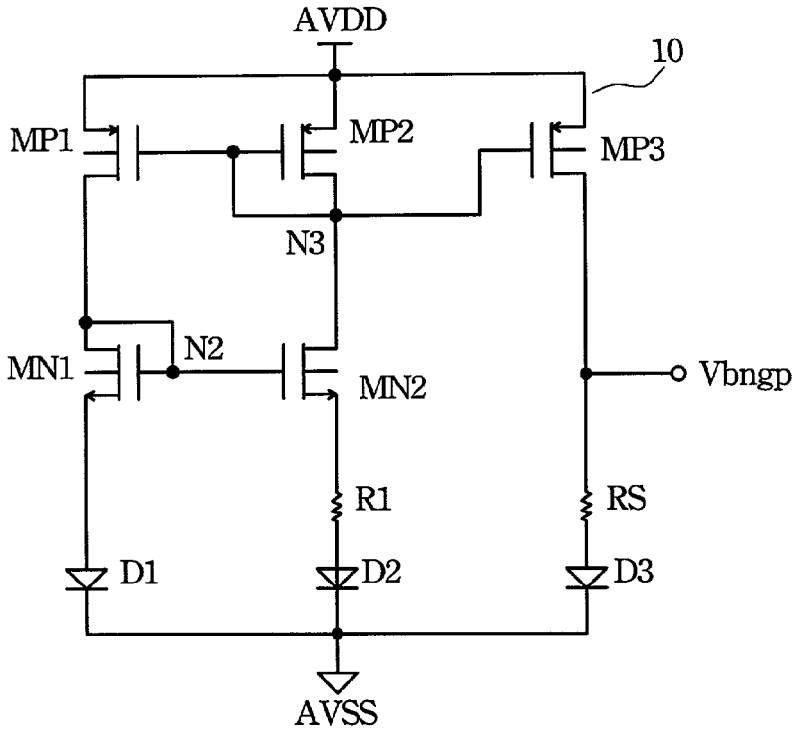
Fig. 1 (Prior Art)
FIG. 1 is a conventional bandgap reference voltage generator of the prior art.
Figure 2:
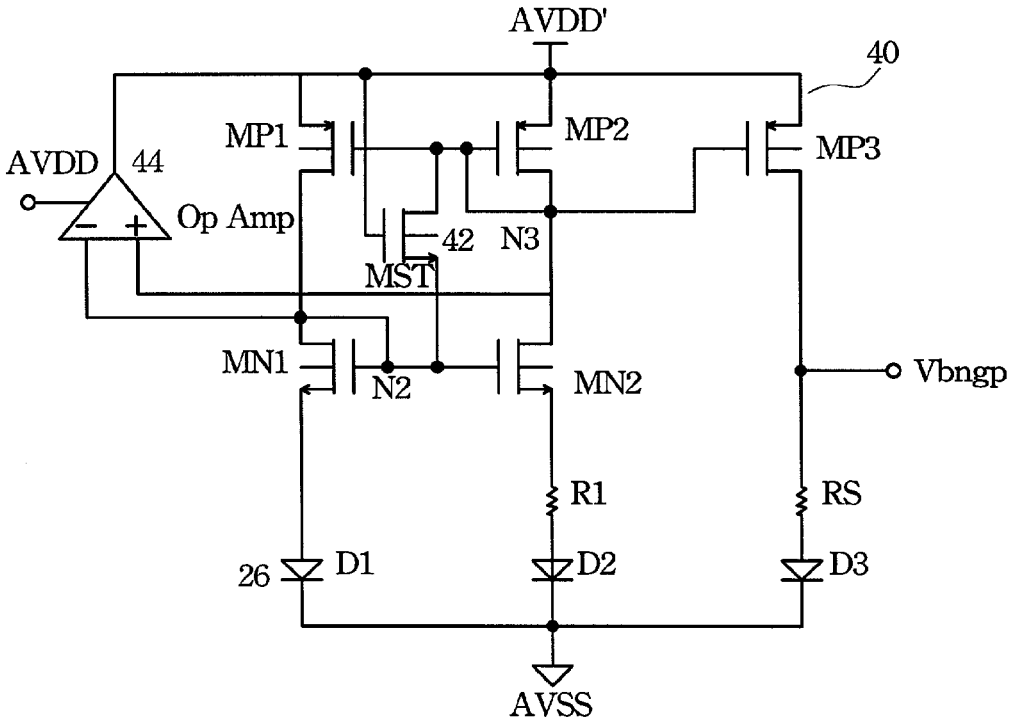
Fig. 2 (Prior Art)
FIG. 2 is a conventional bandgap reference generator with a start-up circuit from prior art.
Figure 3:
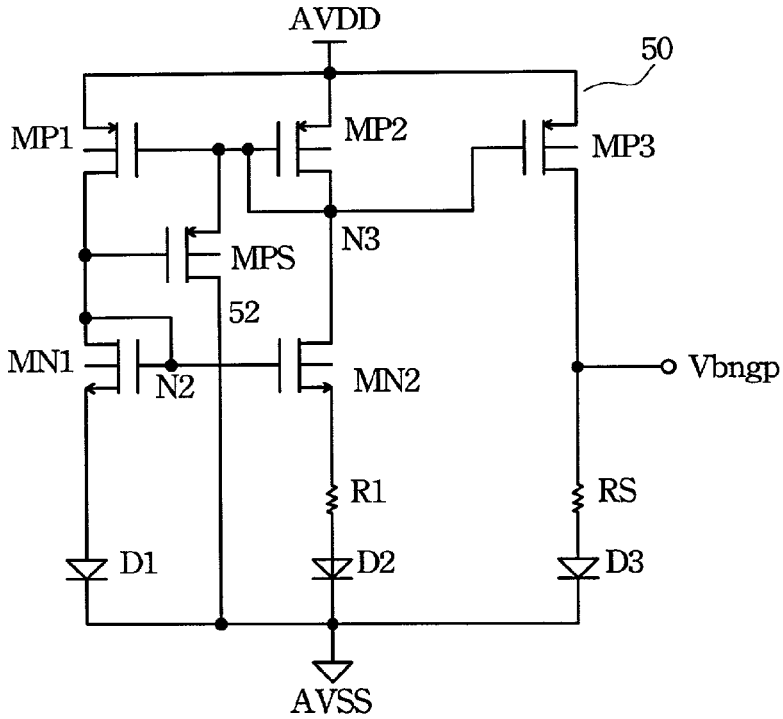
FIG. 3 is the bandgap reference generator with a low-cost, low-power, fast start-up circuit including a P-channel MOSFET according to the present invention.

As illustrated in FIG. 3, the start-up circuit calls for only a MOSFET, MPS 52, which is much lower in hardware overhead than that of prior art (shown in FIG. 2) as the prior art needs a MOSFET and an operational amplifier as its start-up circuit. When the bandgap reference voltage generator is in its normal operating state, the transistor MPS 52 is off, which provides power savings and no offset voltage other than an operational amplifier always appears. But in the prior art, the offset voltage from the operational amplifier will drive a current through the transistor MST 42, and thus MST 42 will operate in the triode region. The dependency curve of the output voltage on the temperature is shifted, and thus the output voltage can not keep a zero temperature dependency on the desired temperature. Obviously, the bandgap reference voltage generator according to the present invention provides a steady and constant output voltage.

Additionally, a large voltage drop (AVDD−AVSS) appearing between the gate and the source of MPS in the present invention will conduct a large current flowing through MPS. The large current is able to rapidly force the bandgap reference voltage circuit into its normal operating state. But in the prior art, the start-up circuit and the bandgap reference voltage circuit is powered by AVDD', which is lower than AVDD. The smaller voltage difference (AVDD'−AVSS) existing between the gate and the source of the transistor MST brings about a longer time taken to pull the voltages at node N2 and node N3 to be substantially the same.

Figure 4:
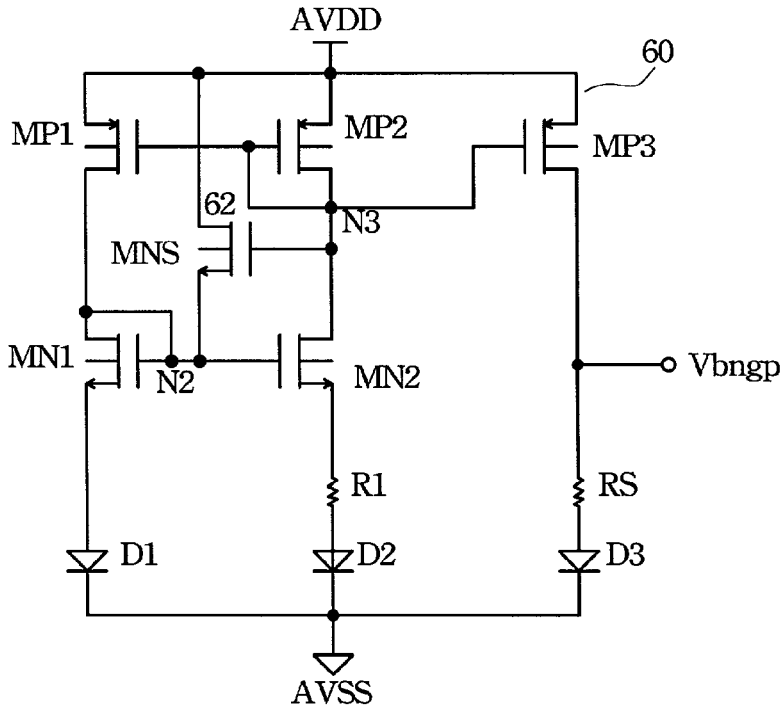
FIG. 4 is the bandgap reference generator with a low-cost, low-power, fast start-up circuit including an N-channel MOSFET according to the present invention.

In another embodiment, the start-up circuit (MPS) 52 in FIG. 3 is replaced by an N-channel MOSFET, which is depicted in FIG. 4. If the generator is in its power-down operating state after an external DC voltage is applied, the node N2 will have the voltage substantially equivalent of AVSS, and the node N3 will have the voltage substantially the same as the external DC voltage AVDD. Consequently, a large voltage drop will exist between the gate and the source of the transistor MNS 62, which is very close to AVDD−AVSS. Because the voltage AVDD−AVSS is significantly larger than the threshold voltage of the MNS 62, the transistor MNS 62 will turn on and conduct a current flowing through MN1 and D1, and thus MN2 flows a current mirrored by the current flowing through the transistor MN1. The current flowing through MNS 62 will pull up the voltage at node N2 and then pull down the voltage at node N3. Added with adjustment on the sizes of the transistor MP1, MP2, MN1 and MN2, the voltage difference between the voltages at the node N2 and the node N3 can be less than the threshold voltage of the transistor MNS 62, and then MNS will be turned off. At such time the output voltage $V_{bngp}$ is well fixed at the correct bandgap voltage.

Figure 5:
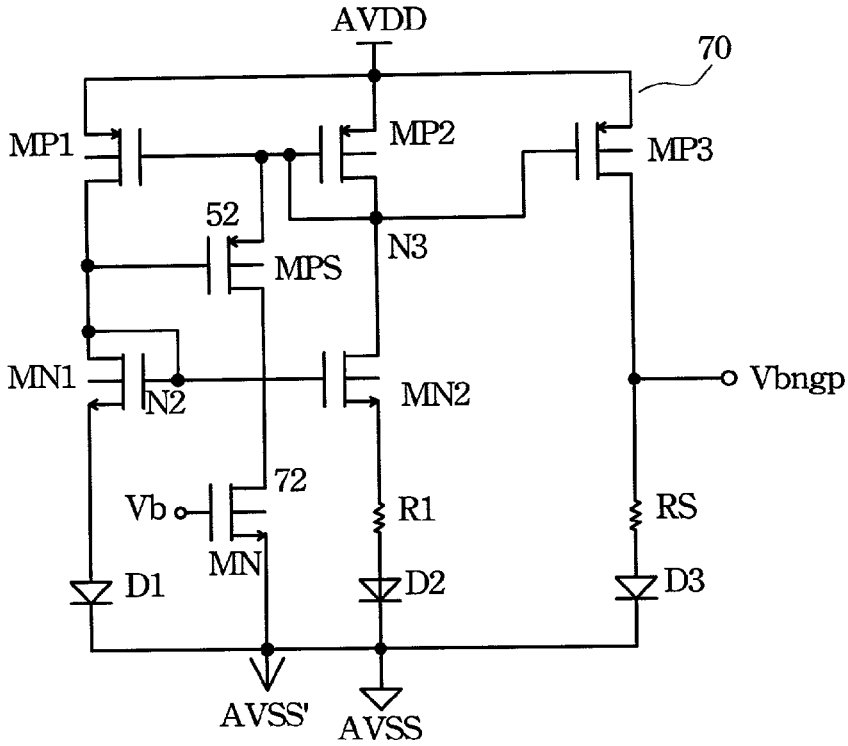
FIG. 5 is the bandgap reference generator with a low-cost, low-power, fast start-up circuit including a P-channel MOSFET and an N-channel MOSFET working as a current source according to the present invention.

In FIG. 5, a current source MOSFET MN 72 is added to the start-up circuit of FIG. 3 to increase the controllability. The gate of the transistor MN 72 is connected to an adequate bias voltage (Vb), the drain is connected to the drain of MPS 52, and the source is connected to an external DC voltage AVSS'. Then, the start-up circuit can be active if MN 72 conducts a current. The start-up circuit can also be inactive if MN 72 is off by applying a proper voltage Vb. To sum up, MN 72 helps controlling the start-up circuit. This is useful when system power-down is required. Additionally, AVSS' can be any voltage that is smallest in the circuit 70.

Figure 6:
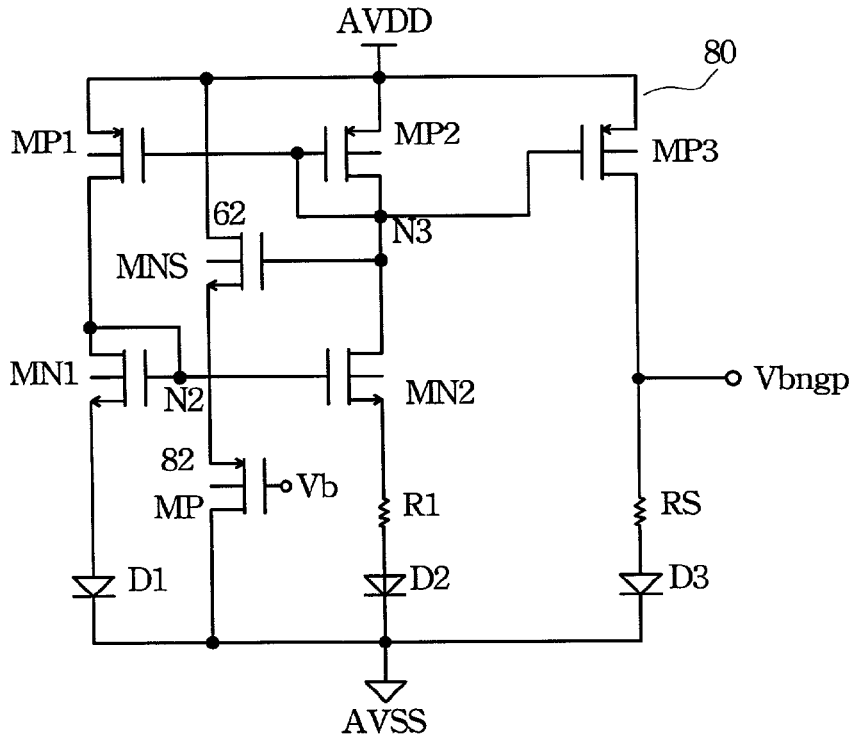
FIG. 6 is the bandgap reference generator with a low-cost, low-power, fast start-up circuit including an N-channel MOSFET and a P-channel MOSFET working as a current source according to the present invention.

Similarly, in FIG. 6, a P-channel MOSFET MP 82 as a current source is added to the start-up circuit of FIG. 4 to increase controllability. The transistor MP 82 functions as a control switch for the start-up circuit.

As is understood by a person skilled in the art, the foregoing preferred embodiments of the present invention are illustrative of the present invention rather than limiting of the present invention. They are intended to cover various modifications and similar arrangements included within the spirit and scope of the appended claims, the scope of which should be accorded the broadest interpretation so as to encompass all such modifications and similar structures.

What is claimed is:

1. A bandgap voltage reference generator for providing a reference voltage, wherein said bandgap voltage reference generator comprises:

a first current mirror, responsive to an input current of said first current mirror for generating a first output current at a first output node of said first current mirror and a second output current at a second output node of said first current mirror, wherein said second output node is coupled to an output of said bandgap voltage reference generator for generating said reference voltage at said output node, wherein said output node is coupled to a first potential through a first electric network;

a second current mirror, including a first node, a second node, a third node and a fourth node, wherein said first node is said first output node, and responsive to said first output current for generating an input current of said second current mirror flowing through said first node to said second node to mirror an output current of said second current mirror flowing through said third node to said fourth node, wherein said second node is coupled to said first potential through a second electric network, and said fourth node is coupled to said first potential through a third electric network; and a startup circuit, comprising a first voltage controlled current source device having two ends, wherein one end of said first voltage controlled current source device is coupled to a second potential, while the other end of said first voltage controlled current source device is coupled to said third node, and wherein said first voltage controlled current source device is controlled by a voltage difference between said first node and said third node for generating a pulling current to pull said first node of said second current mirror and said third node to be substantially the same, wherein said second potential is equal to said first potential in voltage.

2. The bandgap voltage reference generator according to claim 1, wherein said first electric network includes a resistor and a diode in series, said second electric network includes a resistor and a diode in series and said third electric network includes a diode, wherein said diode of said second electric network is larger than said diode of said third electric network in cross sectional area.

3. The bandgap voltage reference generator according to claim 1, wherein said second electric network includes a diode and said third electric network include a resistor and a diode in series wherein said diode of said second electric network is smaller than said diode of said third electric network in cross sectional area.

4. The bandgap voltage reference generator according to claim 1, wherein said first voltage controlled current source device comprises a first MOSFET, being a P-type MOSFET, having a gate, a drain and a source, wherein said gate of said first MOSFET is coupled to said first node, said drain of said first MOSFET is coupled to said second potential, and said source of said first MOSFET is said third node of said second current mirror.

5. The bandgap voltage reference generator according to claim 4, wherein said startup circuit further comprises a second voltage controlled current source device, having two ends, wherein one end of said voltage controlled current source device is coupled to a third potential, while the other end of said second voltage controlled current source device is coupled to said drain of said first MOSFET, and wherein said second voltage controlled current source device is controlled by a voltage difference between a variable voltage and said third potential to conduct said pulling current flowing through said second voltage controlled current source device to said third potential.

6. The bandgap voltage reference generator according to claim 5, wherein said second voltage controlled current source device comprisesa seventh MOSFET, being an N-type MOSFET, having a gate, a drain and a source, wherein said gate of said seventh MOSFET is coupled to said variable potential, said drain of said seventh MOSFET is said other end of said second voltage controlled current source device, and said source of said seventh MOSFET is said end of said second voltage controlled current source device.

7. The bandgap voltage reference generator according to claim 1, wherein said first current mirror comprises:

a second MOSFET, being a P-type MOSFET, having a gate, a drain and a source, wherein said gate of said second MOSFET is coupled to said other end of said first voltage controlled current source device, said drain of said second MOSFET is coupled to said first node, and said source of said second MOSFET is coupled to a fourth potential, wherein said fourth potential is larger than said first potential and said second potential;

a third MOSFET, being a P-type MOSFET, having a gate, a drain and a source, wherein said gate and said drain of said third MOSFET are coupled to said gate of said second MOSFET, said other end of said first voltage controlled current source device and said third node, and said source of said third MOSFET is coupled to said fourth potential; and a fourth MOSFET, being a P-type MOSFET, having a gate, a drain and a source, wherein said gate of said fourth MOSFET is coupled to said drain of said third MOSFET, said drain of said fourth MOSFET is coupled to said output node of said bandgap voltage reference generator, and said source of said fourth MOSFET is coupled to said fourth potential.

8. The bandgap voltage reference generator according to claim 1, wherein said second current mirror comprises:

a fifth MOSFET, being an N-type MOSFET, having a gate, a drain, and a source, wherein said drain of said fifth MOSFET is said third node of, and said source of said fifth MOSFET is said fourth node; and a sixth MOSFET, being an N-type MOSFET, having a gate, a drain, and a source, wherein said gate and said drain of said sixth MOSFET is said first node, and said source of said sixth MOSFET is said second node.

9. The bandgap voltage reference generator according to claim 1, wherein said second potential is less than a voltage difference between said first node and a threshold voltage of said first voltage controlled current source device.

10. A bandgap voltage reference generator for providing a reference voltage, wherein said bandgap voltage reference generator comprises:

a first current mirror, responsive to an input current of said first current mirror for generating a first output current at a first output node of said first current mirror and a second output current at a second output node of said first current mirror, wherein said second output node of said first current mirror is coupled to an output node of said bandgap voltage reference generator for generating said reference voltage at said output node, wherein said output node of said bandgap voltage reference generator is coupled to a first potential through a first electric network;

a second current mirror, including a first node, a second node, a third node and a fourth node, wherein said first node is said first output node of said first current mirror, and responsive to said first output current of said first current mirror for generating an input current of said second current mirror flowing through said first node to said second node to mirror an output current of said second current mirror flowing through said third node to said fourth node, wherein said second node is coupled to said first potential through a second electric network, and said fourth node is coupled to said first potential through a third electric network; and a startup circuit, comprising a first voltage controlled current source device having two ends, wherein one end of said first voltage controlled current source device is coupled to said first node, while the other end of said first voltage controlled current source device is coupled to a second potential, and wherein said first voltage controlled current source device is controlled by a voltage difference between said first node and said third node for generating a pulling current to pull said first node and said third node to be substantially the same in voltage.

11. The bandgap voltage reference generator according to claim 10, wherein said first electric network includes a resistor and a diode in series, said second electric network includes a resistor and a diode in series and said third electric network includes a diode, wherein said diode of said second electric network is nlarger than said diode of said third electric network in cross sectional area.

12. The bandgap voltage reference generator according to claim 10, wherein said second electric network includes a diode and said third electric network includes a resistor and a diode in series wherein said diode of said second electric network is smaller than said diode of said third electric network in cross sectional area.

13. The bandgap voltage reference generator according to claim 10, wherein said first voltage controlled current source device comprises a first MOSFET, being an N-type MOSFET, having a gate, a drain and a source, wherein said gate of said first MOSFET is coupled to said third node, said drain of said first MOSFET is said other end of said first voltage controlled current source device, and said source of said first MOSFET is said first node.

14. The method according to claim 13, wherein said threshold voltage of a N-type MOSFET.

15. The bandgap voltage reference generator according to claim 13, wherein said startup circuit further comprises a second voltage controlled current source device, having two ends, wherein one end of said voltage controlled current source device is coupled to a third potential, while the other end of said second voltage controlled current source device is coupled to said source of said first MOSFET, and wherein said second voltage controlled current source device is controlled by a voltage difference between a variable voltage and a voltage of said source of said first MOSFET to conduct said pulling current flowing through said second voltage controlled current source device to said third potential.

16. The bandgap voltage reference generator according to claim 15, wherein said second voltage controlled current source device comprises a seventh MOSFET, being a P-type MOSFET, having a gate, a drain and a source, wherein said gate of said seventh MOSFET is coupled to said variable potential, said drain of said seventh MOSFET is said end of said second voltage controlled current source device, and said source of said seventh MOSFET is said other end of said second voltage controlled current source device.

17. The bandgap voltage reference generator according to claim 10, wherein said first current mirror comprises:

a second MOSFET, being a P-type MOSFET, having a gate, a drain and a source, wherein said gate of said second MOSFET is coupled to said other end of said first voltage controlled current source device, said drain of said second MOSFET is coupled to said first node, and said source of said second MOSFET is copled to a fourth potential, wherein said fourth potential is larger than said first potential and said second potential;

a third MOSFET, being a P-type MOSFET, having a gate, a drain and a source, wherein said gate and said drain of said third MOSFET are coupled to said gate of said second MOSFET, said other end of said first voltage controlled current source device of and said third node, and said source of said third MOSFET is coupled to said fourth potential; and a fourth MOSFET, being a P-type MOSFET, having a gate, a drain and a source, wherein said gate of said fourth MOSFET is coupled to said drain of said third MOSFET, said drain of said fourth MOSFET is coupled to said output node of said bandgap voltage reference generator, and said source of said fourth MOSFET is coupled to said fourth potential.

18. The bandgap voltage reference generator according to claim 10, wherein said second current mirror comprises:

a fifth MOSFET, being an N-type MOSFET, having a gate, a drain, and a source, wherein said drain of said fifth MOSFET is said third node, and said source of said fifth MOSFET, is said fourth node; and a sixth MOSFET, being an N-type MOSFET, having a gate, a drain, and a source, wherein said gate and said drain of said sixth MOSFET is said first node of said second current mirror.

19. The bandgap voltage reference generator according to claim 10, wherein said second potential is larger than a voltage difference between said second node and a threshold voltage of said first MOSFET.

* * * * *